US005569980A

United States Patent [19]

Worthington et al.

[11] Patent Number: 5,569,980

[45] Date of Patent: Oct. 29, 1996

[54] NON-CONCENTRIC SUPPORT FOR CROSSED-FIELD AMPLIFIER

[75] Inventors: Michael S. Worthington, Hughesville; Kenneth F. Ramacher; Edward M. Doyle, both of Montoursville, all of Pa.

[73] Assignee: Litton Systems, Inc., Woodland Hills, Calif.

[21] Appl. No.: 283,027

[22] Filed: Jul. 29, 1994

[51] Int. Cl.[6] ..... H01J 25/36; H01J 25/50

[52] U.S. Cl. ..... 315/39.3; 315/39.67

[58] Field of Search ..... 315/39.3, 39.51, 315/39.63, 39.67

[56] References Cited

U.S. PATENT DOCUMENTS

| | | | |
|---|---|---|---|
| 2,429,291 | 10/1947 | Okiess | 315/39.69 X |
| 2,582,185 | 1/1952 | Willshaw | 315/39.69 X |
| 2,819,426 | 1/1958 | Shrader | 315/39.63 |
| 4,480,235 | 10/1984 | Gerard | 331/91 |

FOREIGN PATENT DOCUMENTS

| | | | |
|---|---|---|---|
| 783786 | 10/1957 | United Kingdom . | |
| 794545 | 5/1958 | United Kingdom | 315/39.73 |
| 1096591 | 12/1967 | United Kingdom . | |
| 2237140 | 4/1991 | United Kingdom | 315/39.65 |

*Primary Examiner*—Benny T. Lee

*Attorney, Agent, or Firm*—Graham & James LLP

[57] ABSTRACT

A non-concentric matrix support for a crossed-field device is provided. The crossed-field device comprises a cathode, a plurality of anode vanes radially disposed around the cathode, and an interaction region defined between the cathode and innermost tips of the anode vanes. The cathode matrix support is concentrically coupled to the cathode, and has an axis of symmetry parallel to an associated axis of symmetry of the anode vanes, and offset from the axis of symmetry of the anode vanes by a predetermined amount. The non-concentric matrix support further comprises an end-hat disposed at both axial ends thereof with each respective one of the end-hats being uniformly spaced from the anode vanes. In an embodiment, the offset is approximately 0.008 inches.

8 Claims, 4 Drawing Sheets

FIG. 4
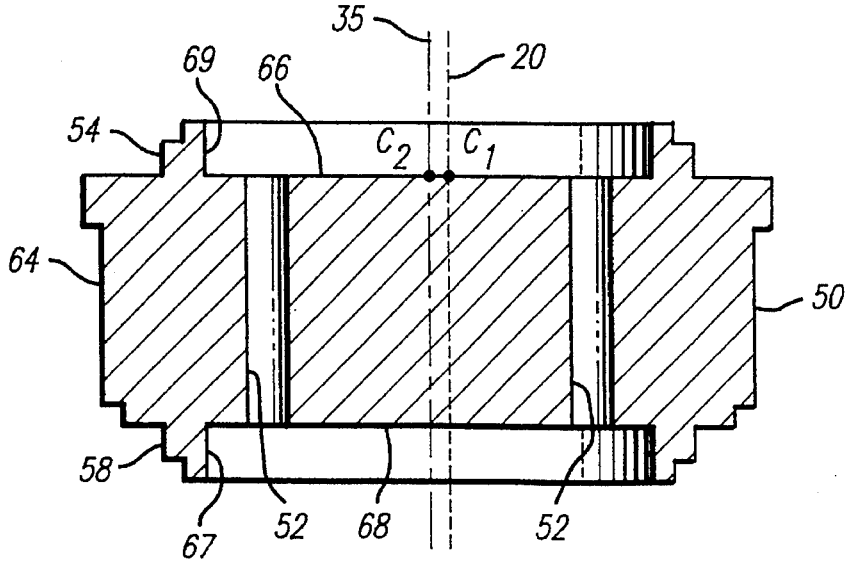
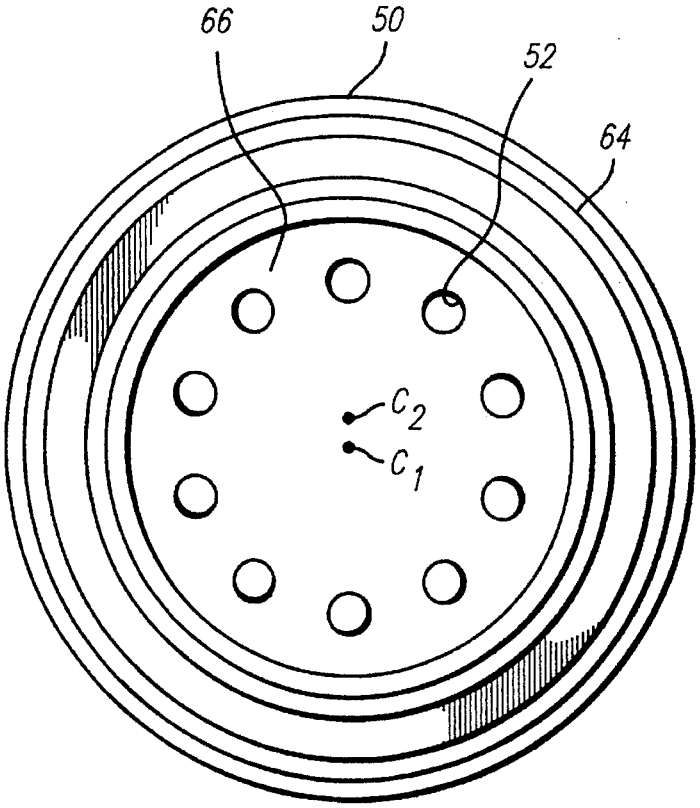
FIG. 5

NON-CONCENTRIC SUPPORT FOR CROSSED-FIELD AMPLIFIER

BACKGROUND OF THE INVENTION

1. Field of the Invention

The present invention relates to crossed-field devices, and more particularly to a non-concentric support for a cathode of a crossed-field amplifier that permits the cathode to be offset with respect to an anode of the amplifier.

2. Description of Related Art

Crossed-field devices, such as magnetrons and crossed-field amplifiers (CFAs), are commonly used to generate microwave RF energy for assorted applications, including radar. The crossed-field devices commonly have a cylindrically shaped cathode centrally disposed a fixed distance from a plurality of radially extending anode vanes. The space between the cathode surface and tips of the anode vanes provides an interaction region, and a potential is applied between the cathode and the anode forming an electric field in the interaction region. A magnetic field is provided perpendicular to the electric field and is directed to the interaction region by polepieces which adjoin permanent magnets. Electrons are emitted from the cathode surface, and are caused to orbit around the cathode in the interaction region due to the crossed magnetic and electric fields, during which the electrons interact with an RF electromagnetic wave moving on the anode vane structure. The electrons give off energy to the moving RF wave, thus generating a high power microwave output signal.

In order to achieve optimum performance from the crossed-field device, it is often necessary to adjust the position of the cathode with respect to the anode vanes. Variations in manufacturing tolerances, materials, and field characteristics can result in the cathode not being optimally located upon manufacture. A common technique for adjusting the position of the cathode with respect to the anode vanes, is to utilize a deformable pole sleeve as part of a support structure for the cathode. By applying a bending force to the pole sleeve, the sleeve can be deformed to tilt the cathode off-axis into a corrected position.

Despite the improvement in cathode performance resulting from optimal adjustment of the cathode position, this technique has numerous drawbacks. First, deformation of the pole sleeve does not have sufficient repeatability in that it is difficult to apply an accurate amount of bending force to the pole sleeve to obtain a desired position for the cathode. Moreover, repeated adjustments in position can ultimately weaken the pole sleeve, rendering the crossed-field device unusable. A second drawback of the technique is that tilting of the cathode axis produces differential relative displacement of the respective end-hats of the cathode, in which a portion of an upper end-hat is drawn to a position closer in proximity to the anode vane tips than an associated portion of a lower end-hat. By disposing the end-hat and vane tips close together at a single region, arcing could occur between the elements at the region, significantly degrading operation of the crossed-field device.

Thus, there is a critical need to provide a cathode for a crossed-field device that is optimally positioned with respect to an associated anode structure without tilting an axis of the cathode.

SUMMARY OF THE INVENTION

In accordance with the teachings of this invention, a non-concentric support for a crossed-field device is provided. The crossed-field device comprises a cathode, a plurality of anode vanes radially disposed around the cathode, and an interaction region defined between the cathode and innermost tips of the anode vanes. The cathode support is concentrically coupled to the cathode, and has an axis of symmetry parallel to and offset from an associated axis of symmetry of the anode vanes.

More particularly, the non-concentric support further comprises an end-hat disposed at both axial ends thereof with each respective end-hats being uniformly spaced from the anode vanes. The support further comprises a plurality of axially disposed coolant channels extending therethrough. In an embodiment of the present invention, the offset is approximately 0.008 inches.

A more complete understanding of the non-concentric support for a crossed-field amplifier will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 4 is a side sectional view of the non-concentric support; and

FIG. 5 is a top view of the non-concentric matrix support.

DETAILED DESCRIPTION OF THE PREFERRED EMBODIMENT

Figure 1:
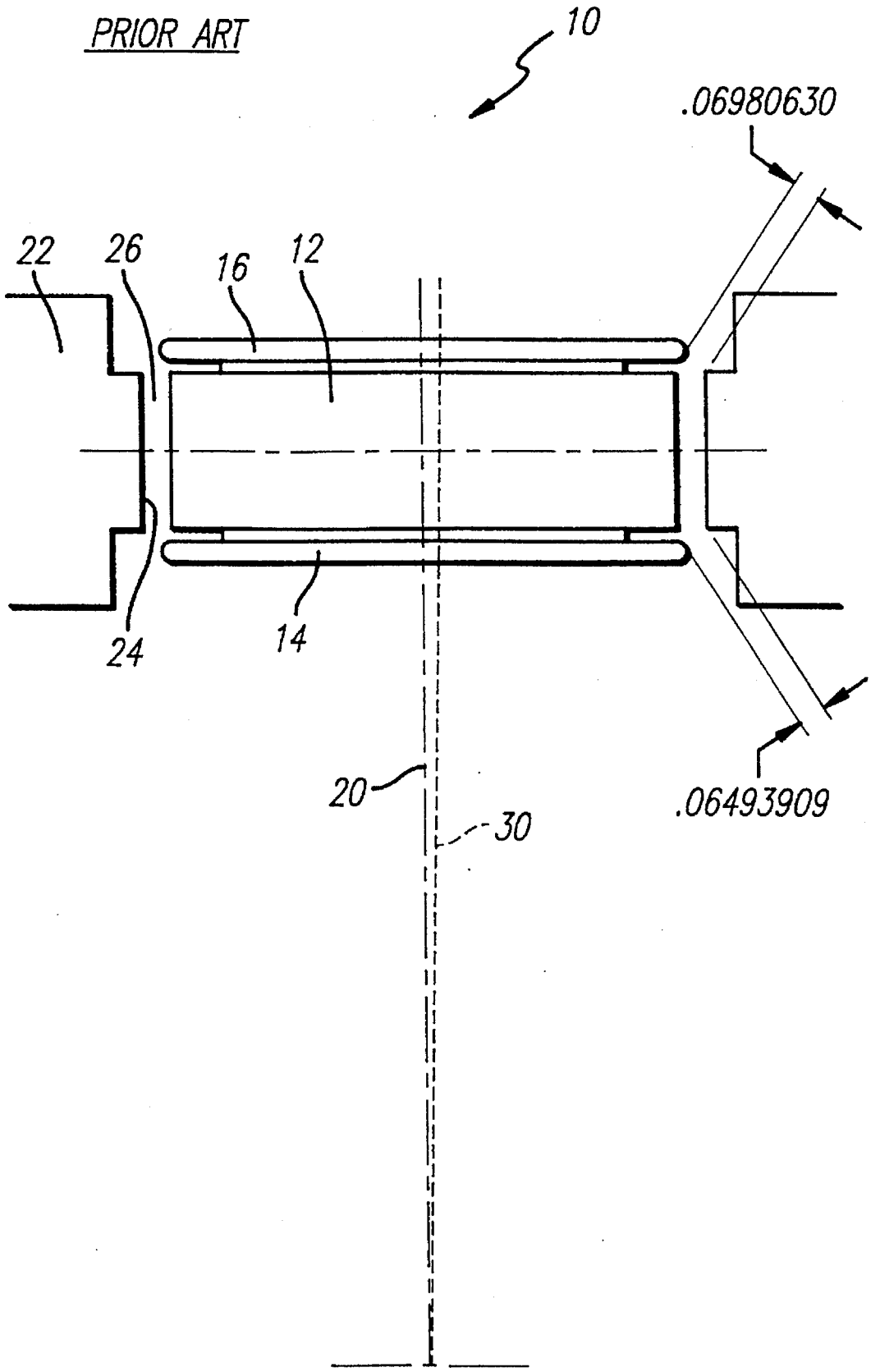
FIG. 1 PRIOR ART
FIG. 1 is a side view of a prior art cathode and associated anode vanes of a crossed-field device in which the cathode is adjusted off-axis to a corrected position with respect to the anode vanes.

This invention provides a cathode for a crossed-field device that is optimally positioned with respect to an associated anode structure without having to tilt the axis of the cathode relative to an associated axis of the anode structure. In the detailed description which follows, reference numerals are used to identify individual elements of the invention and the prior art. It should be understood that like numerals are used to describe like elements of the various figures.

Referring first to FIG. 1, elements of a prior art crossed-field device 10 are illustrated. The crossed-field device 10 comprises a cylindrical shaped cathode 12 disposed within a plurality of radially extending anode vanes 22. The cathode 12 is comprised of an electron emissive material such that electrons can be emitted, either thermionically or through secondary emission by bombardment from priming electrons, in association with application of a potential between the anode vanes 22 and the cathode. An interaction region 26 is defined between the surface of the cathode 12 and innermost tips 24 of the respective vanes 22. The cathode 12 further comprises end-hats 14, 16 disposed above and below the cathode, respectively. The end-hats 14, 16 are ring-shaped having rounded edges. The end-hats 14, 16 are electrically connected to the cathode 12, but are not comprised of an electron emissive material. Accordingly, electrons are not emitted from the end-hats 14, 16 which instead provide boundary regions for the interaction region 26. The cathode 12 and anode vanes 22 have a common axis of symmetry 20.

Because of the nature of the crossed-field device, it may be necessary to adjust the final position of the cathode 12 with respect to the anode vanes 22 in order to obtain optimum performance from the crossed-field device 10. In particular, the cathode 12 may need to be displaced off-center so as to be closer to a particular quadrant of the radial anode vanes 22. The adjustment is typically obtained by applying a bending force to the axis 20 of the cathode in order to draw the surface of the cathode slightly closer to certain tips 24 of the anode vanes 22. The direction of the applied bending force is illustrated graphically by the revised position of the axis of symmetry of the cathode 12, illustrated in phantom at 30. It should be understood that the magnitude of the adjustment is exaggerated for illustrative purposes, and that in practice an adjustment would be very slight, such as on the order of approximately 0.008 inches.

The tilting of the cathode axis results in differential positioning of the respective end-hats 14, 16 with respect to the anode vanes 22. As illustrated in FIG. 1, the upper end-hat 14 is disposed slightly closer (approximately, 0.0649 inches to the anode vane 22 than the lower end-hat 16 (approximately, 0.0698 inches) at a particular point of the circumference of the end-hats. The relative positions of the end-hats can result in arcing between the upper end-hat 14 and anode vane 22 at that particular position. Such arcing is an undesirable consequence and could be detrimental to the operation of the crossed-field device. As a result, the range and magnitude of adjustment to the cathode 12 with respect to the anode vanes 22 is limited.

Figure 2:
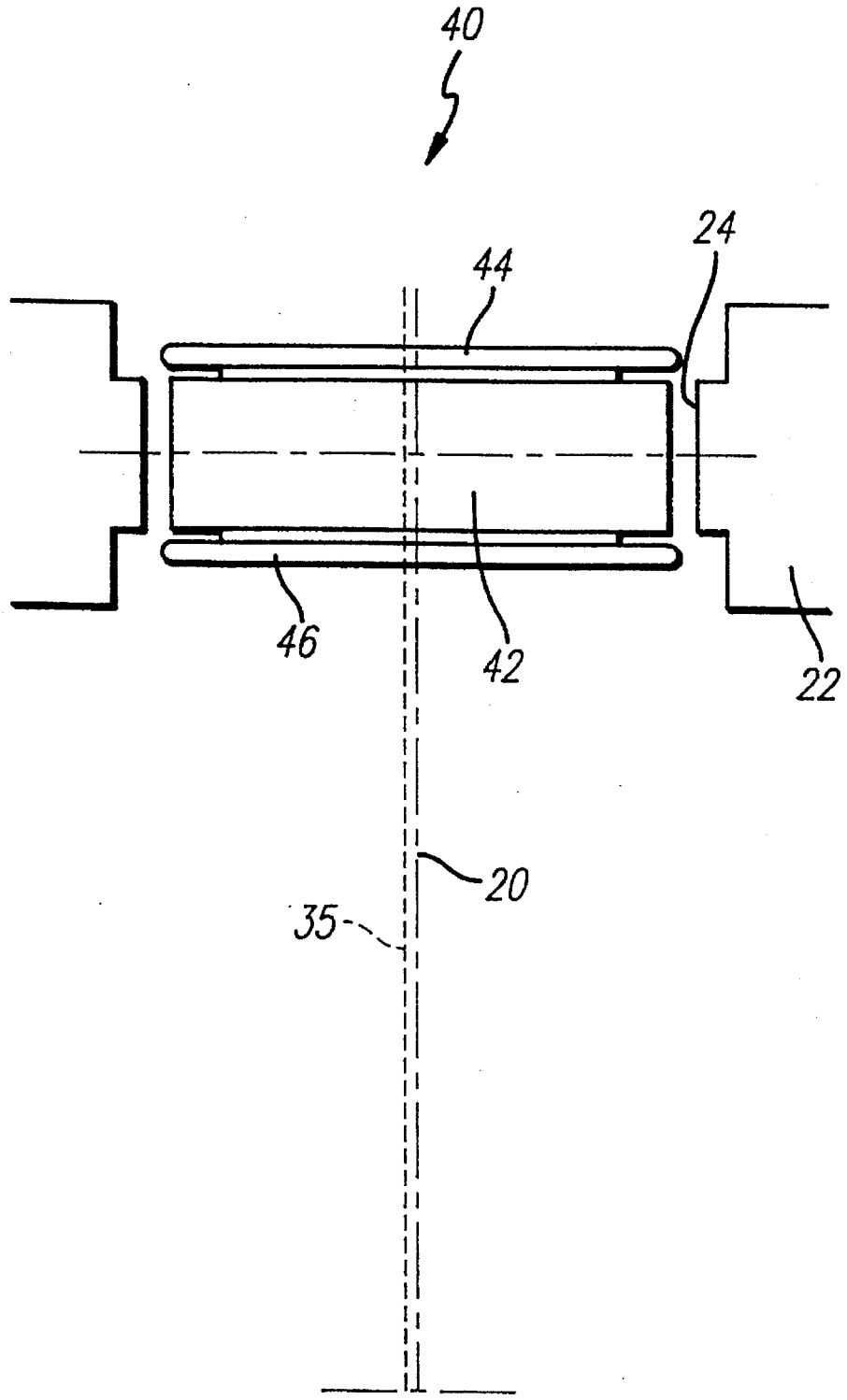
FIG. 2 is a side view of a cathode and associated anode vanes in accordance with the present invention in which the axis of symmetry of the cathode is parallel to and offset from an associated axis of symmetry of the anode vanes.

Referring now to FIG. 2, a crossed-field device 40 of the present invention is illustrated. The crossed-field device 40 also has a cylindrically shaped cathode 42 disposed within a plurality of radially extending anode vanes 22, each having respective vane tips 24. The cathode 42 has upper and lower end-hats 44, 46, respectively. Unlike the cathode 12 of the prior art crossed-field device 10, the cathode 42 has an axis of symmetry 35 offset from the axis of symmetry 20 of the anode vanes 22, and the axis of symmetry 35 lies parallel to the axis of symmetry 20. Accordingly, the distance between the edges of each of the respective end-hats 44, 46 and the anode vanes 22 is substantially uniform, precluding the likelihood of arcing.

Figure 3:
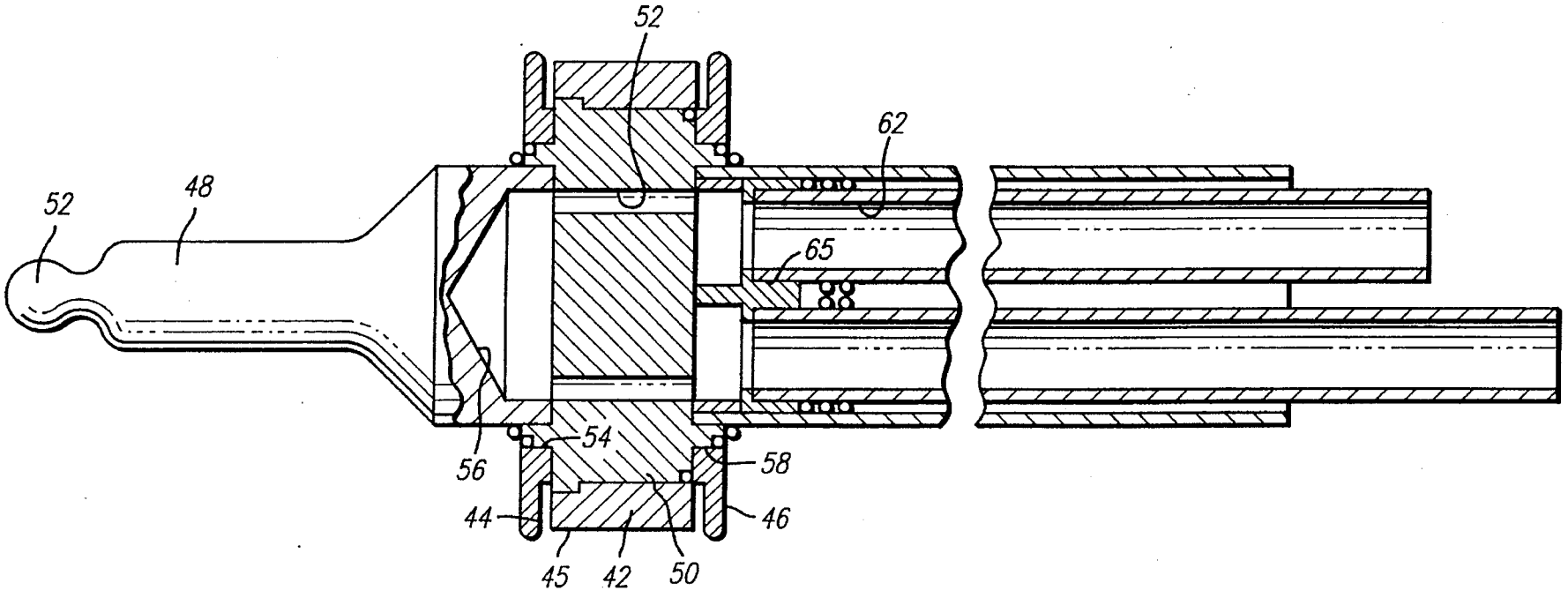
FIG. 3 is a partial sectional side view of a cathode structure having a non-concentric matrix support of the present invention.

FIG. 3 illustrates a cathode structure of the crossed-field device of the present invention in greater detail. The cathode 42 comprises a cylindrical band of electron emissive material that is coupled to a matrix support structure 50, such as by brazing. The matrix support structure 50 is coupled to a central electrode 48 having a ball-shaped contact 52. A negative potential is applied to the contact 52 that is electrically coupled to the cathode 42 through the electrode 48. The end-hats 44, 46 comprise ring-shaped structures having rounded outer edges that protrude slightly outward relative to an outer surface 45 of the cathode 42, and rectangular inner edges that are coupled to shoulders 54, 58, respectively, of the support structure 50.

The support structure 50 further comprises a plurality of coolant channels 52 extending in a substantially axial direction therethrough. The electrode 48 has an internal cavity 56 that joins with the coolant channels 52 of the matrix support structure 50. At an opposite side of the matrix support structure 50, coolant channels 62 are joined with the coolant channels 52 of the matrix support structure through a coolant manifold 65. As known in the art, a flow of a coolant fluid is provided through the coolant channels 62 into the coolant channels 52, so as to maintain the cathode structure at a near constant operating temperature.

FIGS. 4 and 5 illustrate the support structure 50 in greater detail. The matrix support structure 50 has a circular upper surface 66 bounded by a flange 69 (see FIG. 4) that couples to the electrode 48 (not shown), a circular lower surface 68 bounded by a flange 67 (see FIG. 4) that couples to the coolant manifold 65 (see FIG.4), and a side surface 64 that couples to the cathode 42 (not shown). Shoulders 54, 58 (see FIG. 4) are provided for mating with the upper and lower end-hats 44, 46, (not shown) respectively. A plurality of coolant channels 52 (see FIG. 4) extend axially through the entire support structure 50. The matrix support structure 50 is preferably comprised of a thermally and electrically conductive material, such as copper.

The support structure 50 has a true center $C_1$ and an offset center $C_2$. The true center $C_1$ comprises the radial center point for the upper surface 66, lower surface 68, and shoulders 54, 58. The offset center $C_2$ comprises the radial center point of the circular outer surface 64. Accordingly, the true center $C_1$ lies on the axis of symmetry 20 (see FIG.4) of the anode structure, and the offset center $C_2$ lies on the cathode axis of symmetry 35 (see FIG. 4). It is anticipated that the support structure 50 can be fabricated by use of a lathe that turns an unformed block of material about either of the two centers $C_1$, $C_2$. The upper surface 66, lower surface 68, and shoulders 54 would be machined or milled by rotating the unformed block about the true center $C_1$. Then, the outer surface 64 would be machined by rotating the block about the offset center $C_2$. The actual distance between the true center $C_1$ and offset center $C_2$ can be selected based on the particular requirements of the crossed-field device, and in an embodiment of the present invention would be on the order of 0.008 inches.

It should be apparent that through the use of the non-concentric support, the cathode can be offset by a precise amount without the accompanying drawbacks of the prior art technique. Since the end-hats are not offset, but remain concentric with the anode vanes, the risk of arcing between the end-hats and the anode vane is substantially mitigated. Further, the bending stress placed on the cathode structure by the prior art technique is also avoided.

Having thus described a preferred embodiment of a non-concentric support for a cathode of a crossed-field device, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. In a crossed-field device having a cathode, a plurality of anode vanes radially disposed around said cathode, and an interaction region defined between said cathode and respective innermost tips of said anode vanes, an improvement comprising:

a cathode support concentrically coupled to said cathode, said support having an axis of symmetry parallel to an associated axis of symmetry of said anode vanes and offset from said associated axis of symmetry by a predetermined amount, wherein said cathode support further comprises a first end-hat disposed at a first axial end thereof and a second end-hat disposed at a second axial end thereof, each respective end-hat being coaxial with said axis of symmetry of said anode vanes.

2. The improvement of claim 1, wherein said predetermined amount of said offset is approximately 0.008 inches.

3. The improvement of claim 1, wherein said support further comprises a plurality of axially disposed coolant channels extending therethrough.

4. The improvement of claim 1, wherein said cathode is coaxial with said offset axis of symmetry of said cathode support.

5. A crossed-field device, comprising:

a cathode structure comprising an electron emitting outer surface and a cathode support concentrically disposed beneath said outer surface, said cathode structure having a first axis of symmetry; and a plurality of anode vanes disposed around said cathode with an interaction region defined between said cathode outer surface and respective innermost tips of said anode vanes, said anode vanes extending radially about a second axis of symmetry;

wherein said cathode support further comprises a first end-hat disposed at a first axial end thereof and a second end-hat being disposed at a second axial end thereof, each of said end-hats being co-axial with said second axis of symmetry; and wherein said first axis of symmetry is parallel to said second axis of symmetry and offset by a predetermined amount.

6. The crossed-field device of claim 5, wherein said electron emitting surface is co-axial with said first axis of symmetry.

7. The improvement of claim 5, wherein said support further comprises a plurality of axially disposed coolant channels extending therethrough.

8. The crossed-field device of claim 5, wherein said predetermined amount of said offset is approximately 0.008 inches.

* * * * *